United States Patent [19]

Leifeld

[11] Patent Number: 4,805,268

[45] Date of Patent: Feb. 21, 1989

[54] SEPARATING KNIFE ASSEMBLY FOR A CARDING MACHINE OR THE LIKE

[75] Inventor: Ferdinand Leifeld, Kempen, Fed. Rep. of Germany

[73] Assignee: Trützschler GmbH & Co. KG, Monchen-Gladbach, Fed. Rep. of Germany

[21] Appl. No.: 41,296

[22] Filed: Apr. 22, 1987

[30] Foreign Application Priority Data

Apr. 22, 1986 [DE] Fed. Rep. of Germany ..... 3613476
Jan. 29, 1987 [DE] Fed. Rep. of Germany ..... 3702588

[51] Int. Cl.[4] ..... D01G 15/34; D01G 9/20; D01G 15/76

[52] U.S. Cl. ..... 19/105; 19/107

[58] Field of Search ..... 19/98, 99, 105, 106 R, 19/107, 240

[56] References Cited

U.S. PATENT DOCUMENTS

| | | | |
|---|---|---|---|
| 205,805 | 7/1878 | Moog | 19/98 |
| 233,576 | 10/1880 | Taft | 19/98 |
| 1,550,444 | 8/1925 | Marsh | 19/98 |
| 1,977,991 | 10/1934 | Hawkins | 19/98 X |
| 4,530,134 | 7/1985 | Hösel | 19/240 X |

FOREIGN PATENT DOCUMENTS

| | | |
|---|---|---|
| 0473091 | 3/1929 | Fed. Rep. of Germany . |
| 1911439 | 3/1965 | Fed. Rep. of Germany . |
| 2846109 | 11/1980 | Fed. Rep. of Germany . |
| 2814935 | 10/1985 | Fed. Rep. of Germany . |
| 319521 | 4/1957 | Switzerland . |
| 0751964 | 7/1956 | United Kingdom . |
| 2034608 | 6/1980 | United Kingdom . |
| 2046137 | 11/1980 | United Kingdom . |

*Primary Examiner*—Louis K. Rimrodt
*Attorney, Agent, or Firm*—Spencer & Frank

[57] ABSTRACT

A fiber processing machine includes a rotary roller provided with a clothing and having a periphery; and a sepaating knife cooperating with the roller for separating waste from the fiber material entrained by the roller. The knife has a knife edge situated at an adjustable distance from the periphery of the roller. The separating knife is part of a separating knife assembly including an adjusting device for varying a position of the separating knife relative to the roller and for immobilizing the separating knife in a desired adjusted position; and a drive for operating the adjusting device.

11 Claims, 5 Drawing Sheets

1
2
3
3a
A
4
5
6
7
8
9
10
11
12
13
14'
14''
15'
15''
16'
16''
17'
17''
18'
18''

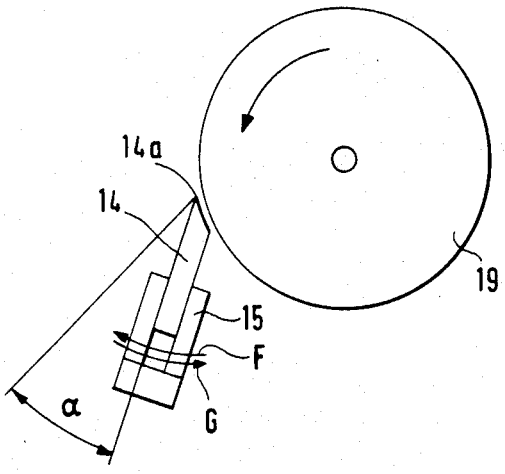
FIG. 3a
FIG. 3b
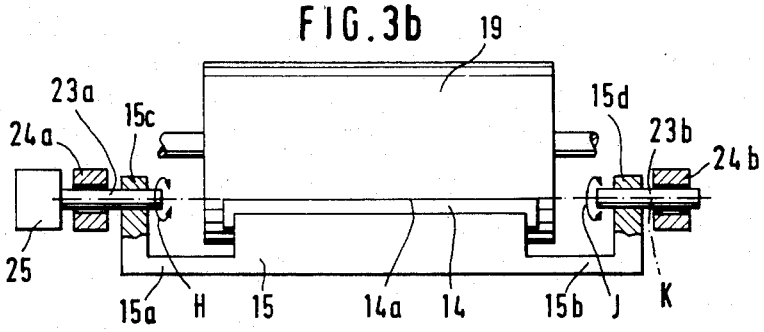
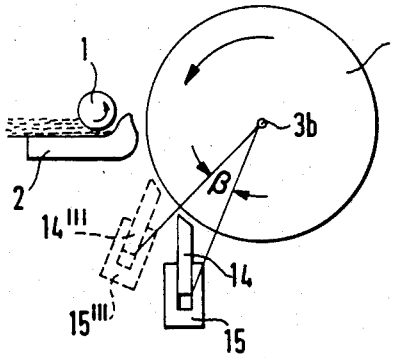
FIG. 4

SEPARATING KNIFE ASSEMBLY FOR A CARDING MACHINE OR THE LIKE

BACKGROUND OF THE INVENTION

This invention relates to a knife assembly for a carding machine, cleaning machine or the like for treating cotton fibers and is of the type which has at least one separating knife associated with a roller or cylinder of the machine. The separating knife has a knife edge oriented against the direction of rotation of the roller and the separating knife is adjustable towards and away from the periphery of the roller.

In cards or cleaning machines the separating knives serve for removing dust, waste or trash from useful fibers adhering to the clothing of the fiber-treating roller. In cleaners the separating knives are used in conjunction with sawtooth rollers, while in carding machines the separating knives are used at the licker-in, the main carding cylinder or in cooperation with suction hoods or suction tubes. The section hoods have the purpose to carry away, in an air stream, trash, short fiber and dust particles separated by the knife. Conventionally, the knives are adjusted before operation, that is, the location of the knife, the distance of the knife edge from the roller (cylinder) and the angular position of the separating flank of the knife to the tangent of the roller are constant during the operation of the machine. This arrangement is disadvantageous in that changing the positional parameters is often difficult and therefore can be carried out only while the machine is at a standstill. The distance of the knife edge (tip) to the sawtooth clothing of the roller, for example, the licker-in may be between 0.2 to 0.6 mm dependent upon the fiber material to be processed. The setting of the distance is conventionally carried out manually with the aid of a spacer gauge while the machine is at a standstill. A readjustment of the knife is often desirable in order to adapt it to various materials, particularly to materials which have different dirt contents or dirt types.

SUMMARY OF THE INVENTION

It is an object of the invention to provide an improved knife assembly from which the discussed disadvantages are eliminated and with which in particular the degree of foreign body separation (degree of cleaning) is improved.

This object and others to become apparent as the specification progresses, are accomplished by the invention, according to which, briefly stated, there is provided an adjusting mechanism by means of which the distance of the separating knife from the periphery of the associated roller may be varied and immobilized in a desired position and further, the adjusting mechanism is operated by a driving mechanism.

By virtue of the adjusting mechanism which varies the position of the knife (for example, its distance from the roller) with the aid of a drive mechanism (such as a motor), an optimal material separation may be achieved in a simple manner before and during operation when the fiber material to be processed is changed. The drive mechanism makes possible a fine length adjustment. The setting (adjusting) mechanism immobilizes the knife in a desired determined position, for example, by virtue of stopping the drive motor of the setting device. In this manner, an optimal separation is achieved. Advantageously, an adjustment is made possible during the operation of the machine because knife adjustment may be effected while the separation is observed or while the waste stream is measured to thus achieve an exact reproducible separation.

Preferably, the separating knife is affixed to an adjustable intermediate carrier. Advantageously, with the separating knife or intermediate carrier there are associated intermediate tightening devices for example, intermediate abutments, positioning devices or the like. Expediently, with the separating knife or intermediate carrier there is associated a terminal immobilizing device such as a terminal abutment or terminal positioning device. Advantageously, the setting device permits a stepless adjustment. According to a further advantageous feature of the invention, the separating knife or the intermediate holder is arranged for executing a translatory movement (that is, a shift radially relative to the roller). According to a further feature of the invention, the adjusting device includes an adjusting mechanism which sets the angular position of the separating knife relative to the roller with which the knife cooperates. Preferably, there is provided a device for shifting the separating knife parallel to the upper face of the roller. Preferably, with the separating knife or the intermediate carrier there is associated a path sensor which is connected by means of a control device with the drive mechanism of the setting device. According to a further advantageous feature of the invention, with the separating knife there is associated a measuring device which determines the quantities of the separated inpurities such as trash, waste, dust or the like and which is connected with the control device.

BRIEF DESCRIPTION OF THE DRAWING

FIG. 3*a* is a schematic side elevational view of components of another preferred embodiment of the invention.

FIG. 3*b* is a front elevational view of the embodiment illustrated in FIG. 3*a*.

FIG. 4 is a schematic side elevational view of components of still another preferred embodiment of the invention.

DESCRIPTION OF THE PREFERRED EMBODIMENTS

Figure 1:
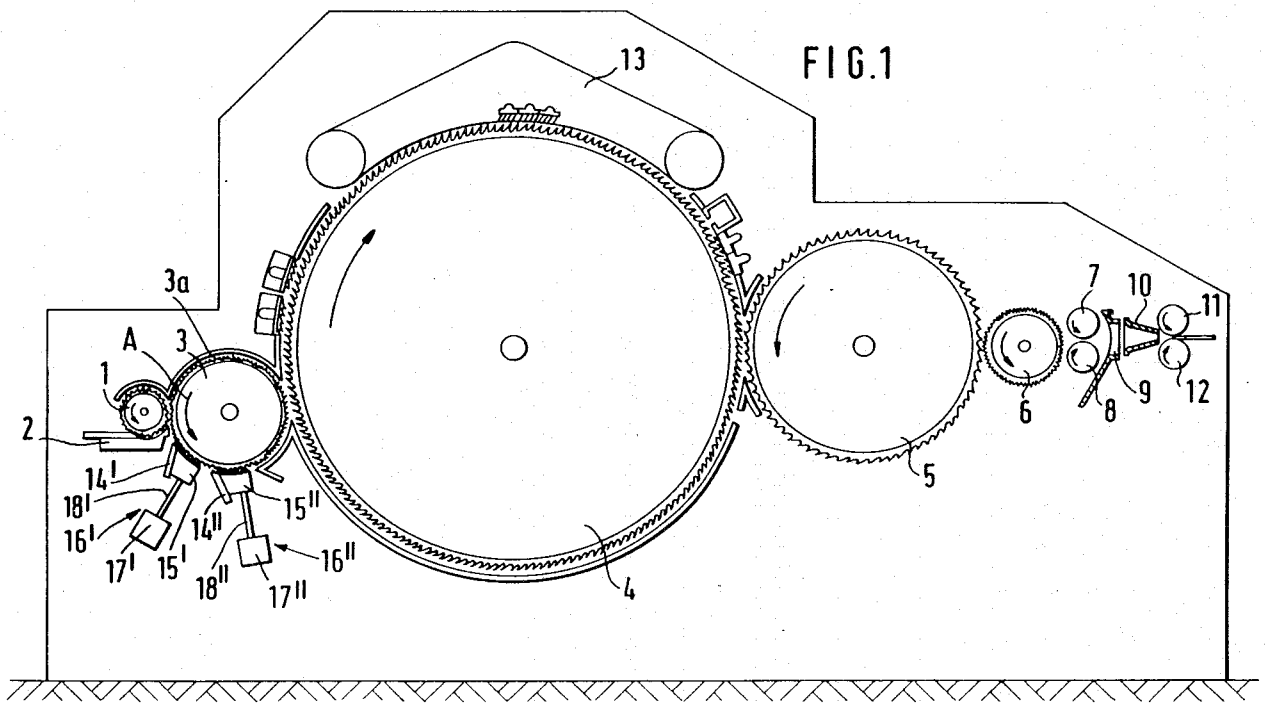
FIG. 1 is a schematic side elevational view of a carding machine incorporating the invention.

Turning to FIG. 1, there is illustrated a carding machine which may be an "EXACTACARD DK 715" model, manufactured by Trützschler GmbH & Co. KG, Mönchengladbach, Federal Republic of Germany. The carding machine has a feed roller 1, a feed table 2, a licker-in 3, a main carding cylinder 4, a doffer 5, a stripper roller 6, crushing rollers 7 and 8, a web guiding element 9, a sliver trumpet 10, calendar rollers 11 and 12 as well as travelling flats 13. The licker-in 3 has a sawtooth clothing 3*a*.

Underneath the licker-in 3 there are arranged two knives 14', 14'' whose knife edge is oriented against the direction of rotation (arrow A) of the licker-in 3. The knives 14', 14'' are mounted on a respective intermediate carrier 15', 15'' with which there are associated respective setting devices 16', 16''. The latter have respective drive motors 17', 17'' and threaded spindles 18', 18''.

Figure 2:
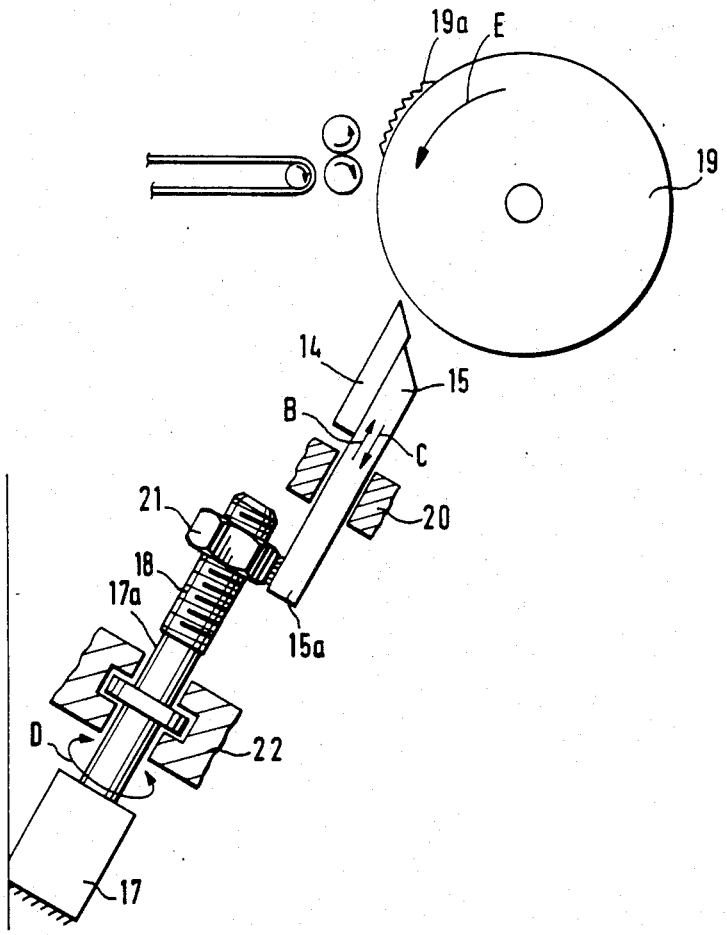
FIG. 2 is a side elevational view of a preferred embodiment of the invention.

Turning now to FIG. 2, underneath a toothed roller 19 which has a clothing 19*a*, a direction of rotation E, and which is associated with a fiber cleaning machine (not shown), there is arranged a separating knife 14 which is mounted on an intermediate carrier 15 which is movable generally radially relative to the roller 19 in a translatory manner within a stationarily supported guide 20 (which is affixed to a machine component, not shown) in the direction of oppositely oriented arrows B and C. The knife 14 may be releasably mounted (for example, by screws) on the intermediate carrier 15 for replacement and sharpening, or the knife 14 and the intermediate carrier 15 may be of a one-piece, unitary construction. To that end 15*a* of the intermediate carrier 15 which is oriented away from the knife 14 there is peripherally welded a nut 21. Further, a stationarily supported drive motor 17 is provided whose output shaft 17*a* is rotatable in either direction as indicated by the two-directional arrow D. The shaft 17*a* is supported in a stationary bearing 22 and has a terminal spindle 18 on which the nut 21 is threaded.

Upon rotation of the shaft 17*a* the nut 21, the intermediate carrier 15 and the knife 14 are moved in the direction of the arrow B or C. The drive motor 17 serves as a positioning drive, that is, it displaces the knife 14 and also immobilizes it in the desired position. Particularly in case of a small pitch of the thread of the spindle 18 and the nut 21 the knife 14 may be steplessly set with high precision and immobilized in the adjusted position by virtue of stopping the motor 17, expediently a d.c. motor. The drive motor 17 may be actuated and stopped manually by operating a switch. It will be understood that instead of an electric motor 17 a hydraulic cylinder unit may be used as the drive mechanism.

Turning now to FIGS. 3*a* and 3*b*, the knife 14 is rotatable about an axis which coincides with the knife edge 14*a*. The intermediate carrier 15 on which the knife 14 is mounted is thus pivotal through an angle $\alpha$ in the direction of the arrows F and G. The knife carrier 15 has, on either side, angle members 15*a*, 15*b* whose respective ends 15*c* and 15*d* have respective passages arranged in alignment with the knife edge 14*a*. Pivot pins 23*a*, 23*b* which are rotatably held in stationarily supported bearings 24*a* and 24*b*, extend through the passages of the angle members 15*a*, 15*b* and are affixed thereto, for example, with a press fit. By virtue of this arrangement the assembly 14, 15 is pivotal in the direction of the double-headed arrows H and J about an axis of rotation K. With the pivot pin 23*a* there is connected a pivot drive 25 such as a motor, gearing or the like, to effect the pivotal motion of the knife 14.

Turning to FIG. 4, the knife 14 may be locally shifted from the solid-line position into the phantom-line position. In the latter position, the knife is designated at 14'''. By virture of this shift, the location of engagement of the knife 14 with the roller (licker-in 3) is changed. For this purpose, the intermediate carrier 15 is pivotal as a unit with the knife 14 about the center 3*b* of the licker-in 3 through an angle $\beta$. In this manner, the knife 14 is shifted parallel to the upper face of the licker-in 3. The closer the knife 14 to the location of the fiber transfer from the feeding device (feed roller 1 and feed table 2) to the licker-in 3, the smaller the proportion of the useful fibers separated out in addition to the foreign bodies.

Figure 5:
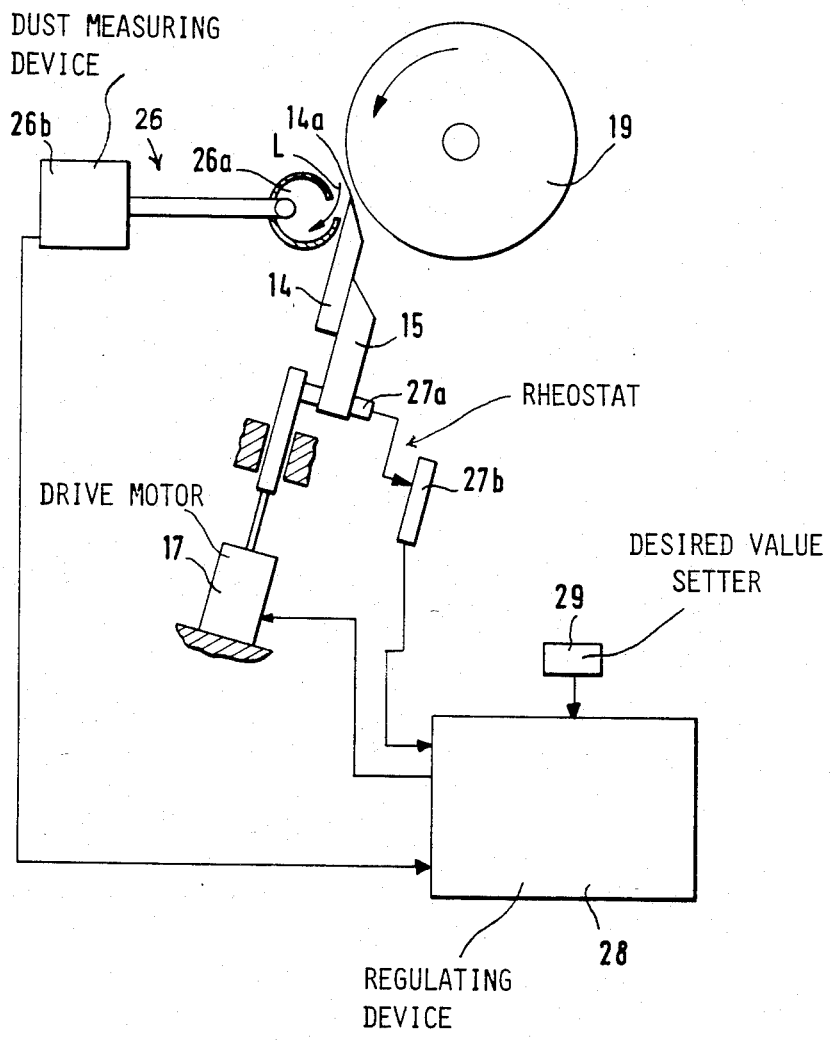
FIG. 5 is a schematic side elevational view of yet another preferred embodiment of the invention.

Turning now to FIG. 5, a measuring unit 26 is associated with the separating knife 14 for determining the quantities of the separated impurities such as trash, waste, dust or the like. The impurities enter in the direction of the arrow L in the zone of the separating knife edge 14*a* into the measuring device 26 which has a trash and dust removing conduit 26*a* and a particle counting device or dust measuring device 26*b*. A path sensor rheostat 27*a*, 27*b* is connected with the carrier 15 for monitoring the radial position of the separating knife 14. The path sensor 27*a*, 27*b* (position indicator) is connected with a control and regulating device 28 which has a desired value setter 29 for determining the position of the separating knife 14 as a function of the dust and trash contents detected in the measuring device 26. For this purpose, an output of the measuring device 26*b* is connected with an input of the regulating device 28 and an output of the latter is connected with an input of the motor 17. In this manner, with the drive motor 17 an automatic setting of the distance of the separating knife 14 from the sawtooth roller 19 may be effected as a function of the quantities of the separated impurities as determined by the measuring unit 26. The control and regulating device 28 has a memory (not shown) which contains data regarding the relationship between the position of the separating knife 14 and the particle content.

The settable separating device according to the invention improves the setting of the cleaning device for the fiber material.

Figure 6A:
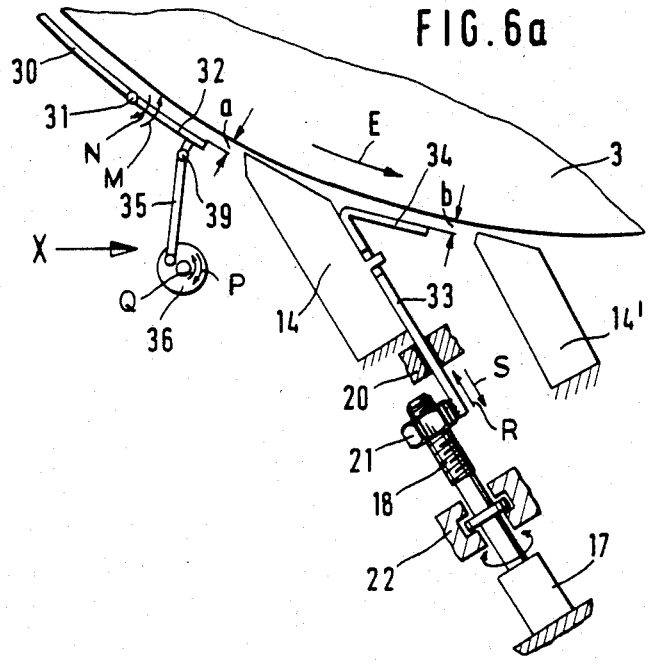
FIG. 6*a* is a side elevational view of another preferred embodiment of the invention.
Figure 6B:
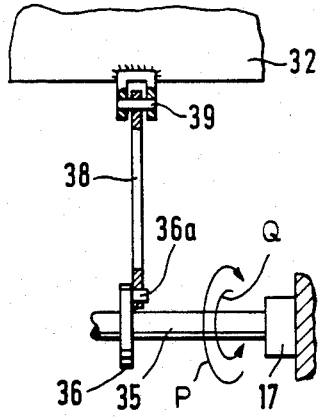
FIG. 6*b* is a front elevational view of several components as viewed in the direction of arrow X of FIG. 6*a*.

FIG. 6*a* shows a licker-in 3 with which there are associated two separating knives 14, 14' which have a knife edge oriented against the direction of rotation E. With the roller periphery there is associated a cover 30 to the end of which there is fastened a guide element 32 by means of an articulation 31. The guide element 32 is rotatable in the direction of the arrows M and N. As shown in FIG. 6*b*, the guide element 32 may be shifted by means of a pivotal joint 39, a push rod 38, a disc 36 with pins 36*a*, a rotary shaft 35 and a drive motor 17 which may rotate the shaft 35 in either direction as indicated by the arrows P and Q. On the rear side of the knife 14 there is secured a holding element 33 on one end of which there is arranged a guide element 34 conforming to the periphery of the licker-in 3. The guide element 34 is displaceable in the direction of the arrows R, S. The respective distances a and b of the guide elements 32 and 34 from the periphery of the licker-in 3 are automatically settable by the setting device 17, 35, 36, 36*a*, 38, 39 and 17, 18, 20, 21, 22, respectively, with the use of the control device according to FIG. 5. By changing the distance a and b, the separating effect of the respective downstream-located knives 14 and 14' is changed and affected.

It will be understood that the above description of the present invention is susceptible to various modifications, changes and adaptations, and the same are intended to be comprehended within the meaning and range of equivalents of the appended claims.

What is claimed is:

1. In a fiber processing machine including a rotary roller provided with a clothing and having a periphery; and a separating knife cooperating with the roller for separating waste from the fiber material entrained by the roller; said knife having a knife edge situated at an adjustable distance from the periphery of the roller; the improvement comprising (a) an adjusting device including means for varying a position of said separating knife relative to said roller and means for immobilizing said separating knife in a desired adjusted position;

(b) drive means for operating said adjusting device;

(c) a path sensing means operatively connected to said separating knife for generating signals representing the location of said separating knife; and (d) a control device connected to said path sensing means for receiving signals from said path sensing means; said control device being connected to said drive means.

2. A fiber processing machine as defined in claim 1, further comprising a displaceably supported carrier; said separating knife being mounted on said carrier.

3. A fiber processing machine as defined in claim 1, wherein said adjusting device and said drive means include means for steplessly varying the position of said separating knife.

4. A fiber processing machine as defined in claim 1, wherein said adjusting device and said drive means include means for shifting said separating knife radially with respect to said roller.

5. A fiber processing machine as defined in claim 1, wherein said adjusting device and said drive means include means for pivotally displacing said separating knife.

6. A fiber processing machine as defined in claim 5, wherein said separating knife has a knife edge extending generally parallel to a rotary axis of said roller; said means for pivotally displacing said separating knife including means for pivoting said separating knife about an axis coinciding with said knife edge.

7. A fiber processing machine as defined in claim 1, wherein said adjusting device and said drive means include means for shifting said separating knife parallel to the periphery of said roller.

8. A fiber processing machine as defined in claim 1, further comprising a waste measuring means exposed to a stream of waste separated by said separating knife for generating signals representing waste quantities; said waste measuring means being connected to said control device for applying the signals of said waste measuring means to said control device.

9. A fiber processing machine as defined in claim 1, wherein said drive means comprises a motor.

10. A fiber processing machine as defined in claim 1, wherein said drive means comprises an electric motor.

11. In a fiber processing machine including a rotary roller provided with a clothing and having a direction of rotation and a periphery; a separating knife cooperating with the roller for separating waste from the fiber material entrained by the roller; and a guide element adjoining said separating knife and conforming to and extending at a distance from the periphery of said roller, the improvement comprising an adjusting device including means for varying the distance of said guide element from said roller and means for immobilizing said guide element in a desired adjusted position; and drive means for operating said adjusting device.

* * * * *